US008011967B2

(12) United States Patent
Sawai et al.

(10) Patent No.: US 8,011,967 B2
(45) Date of Patent: Sep. 6, 2011

(54) WATERTIGHT CONNECTOR AND METHOD OF MANUFACTURING THE SAME

(75) Inventors: Takashi Sawai, Tokyo (JP); Akinori Mizumura, Kanagawa (JP)

(73) Assignees: Olympus Medical Systems Corp., Tokyo (JP); Molex Incorporated, Lisle, IL (US)

( * ) Notice: Subject to any disclaimer, the term of this patent is extended or adjusted under 35 U.S.C. 154(b) by 110 days.

(21) Appl. No.: 12/438,378

(22) PCT Filed: Aug. 22, 2007

(86) PCT No.: PCT/US2007/018578

§ 371 (c)(1),
(2), (4) Date: Aug. 10, 2009

(87) PCT Pub. No.: WO2008/024402

PCT Pub. Date: Feb. 28, 2008

(65) Prior Publication Data

US 2010/0291802 A1 Nov. 18, 2010

(30) Foreign Application Priority Data

Aug. 22, 2006 (JP) ..... 2006-225402

(51) Int. Cl.
*H01R 33/00* (2006.01)

(52) U.S. Cl. ..... 439/660; 439/736

(58) Field of Classification Search ..... 439/660, 439/736, 579, 310, 315; 29/883
See application file for complete search history.

(56) References Cited

U.S. PATENT DOCUMENTS

| | | | | |
|---|---|---|---|---|
| 4,576,144 | A | 3/1986 | Ishii | |
| 4,715,119 | A | 12/1987 | Joosten | |
| 5,871,371 | A | 2/1999 | Rothenberger et al. | |
| 6,935,881 | B2 * | 8/2005 | Kainz et al. | 439/310 |
| 2003/0085794 | A1 | 5/2003 | Ishihara | |
| 2004/0053528 | A1 | 3/2004 | Kainz et al. | |
| 2006/0141861 | A1 | 6/2006 | Darley et al. | |
| 2008/0281157 | A1 * | 11/2008 | Miyagi et al. | 600/132 |
| 2008/0281158 | A1 * | 11/2008 | Miyagi et al. | 600/152 |

FOREIGN PATENT DOCUMENTS

| | | |
|---|---|---|
| JP | 61-237383 | 10/1986 |
| JP | 10-022007 | 1/1998 |
| JP | 2003006576 | 1/2003 |
| JP | 2004039437 | 2/2004 |
| JP | 2006019186 | 1/2006 |
| JP | 2006-260894 | 9/2006 |

OTHER PUBLICATIONS

International Search Report for PCT/US2007/018578.

* cited by examiner

*Primary Examiner* — Neil Abrams
*Assistant Examiner* — Phuongchi T Nguyen
(74) *Attorney, Agent, or Firm* — Hahn & Voight PLLC; Roger C. Hahn

(57) ABSTRACT

A waterproof connector with sealing capability includes a connector housing with a plurality of conductive terminals mounted therein. The terminals are arranged around the perimeter of a circle with contact portions exposed at the radial outermost extents along the circle. The housing has a central opening around which the terminals are arranged and the terminals are each bent into a circular arc in their mounting on the housing. The housing is over molded around the terminal at intermediate portions thereof to provide a liquid proof barrier.

9 Claims, 14 Drawing Sheets

FIG.13b
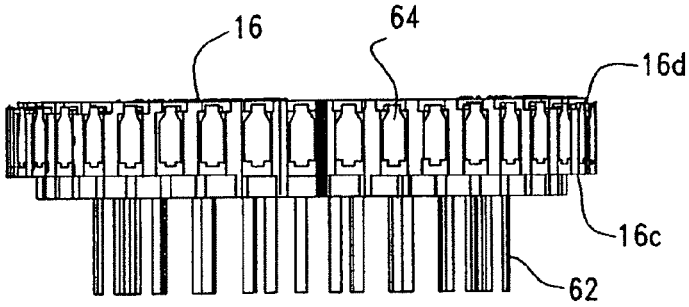
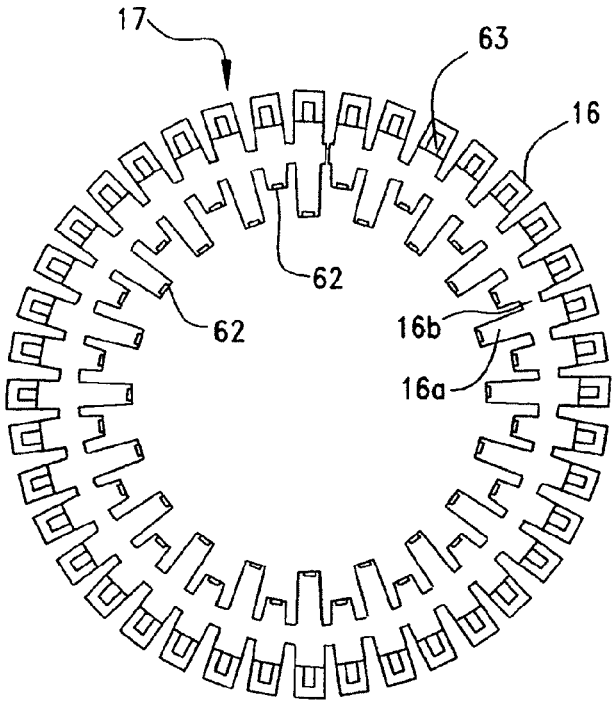
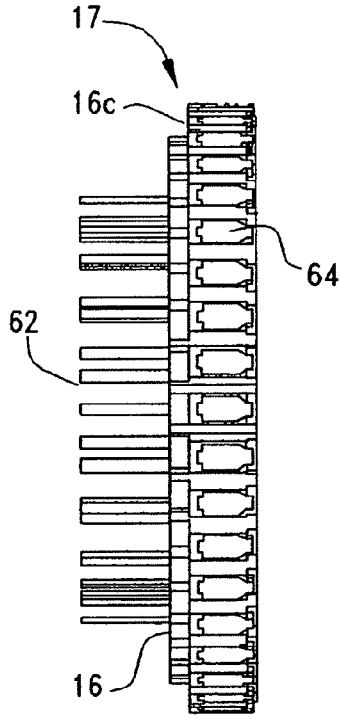
FIG.13a
FIG.13c (PRIOR ART)

WATERTIGHT CONNECTOR AND METHOD OF MANUFACTURING THE SAME

BACKGROUND OF THE INVENTION

The present invention relates generally to a watertight connector and a method of manufacturing the same.

In a conventional connector, terminals made of metal rod-like members are press-fit in through holes formed in a bottom plate of a housing made of an insulating material such as a synthetic resin. In this case, a gap inevitably occurs between the inner wall surface of the through hole and the outer circumference of the terminal, and therefore, it is difficult to maintain a sealing performance between one surface side of the bottom plate from which tip portions of the terminals project to make contact with counterpart connector terminals and the other surface side of the bottom plate from which root portions of the terminals project to make contact with electrical wires or the like of a cable.

For this reason, in the case of a connector requiring cleaning such as a connector used for medical devices, for instance, cleaning liquid, used for cleaning the side of the bottom plate from which the tip portions of the terminals project to contact the counterpart connector terminals, may enter the side of the bottom plate at which the terminals are to be connected to the electrical wires or the like of the cable, and it may have adverse effects such as corrosion of the connecting portions of the root portions of the terminals and the electrical wires or the like, and cracking caused by deterioration.

Also, in a cable including a further linear member such as an optical fiber or the like and electrical wires integrally arranged with the further linear member, the electrical wires, in some cases, are annularly arranged around the centrally arranged further linear member so as to surround the latter. Such a cylindrical connector for connecting the annularly arranged electrical wires is proposed (refer to Japanese Patent Application Laid-Open Publication (Kokai) No. S61-237383, for instance).

FIG. 19 is a cross-sectional view of such a conventional cylindrical connector.

In FIG. 19, reference numeral 801 designates a connector terminal, and a plurality of terminals are annularly arranged so as to surround the center axis of the connector. Also, reference numeral 802 designates an elementary portion in which the terminal 801 is fitted, and the elementary portions are integrally connected to a belt-like strip 803. The elementary portions 802 and the strip 803 are made of an elastic plastic and are integrally molded by a molding method such as injection molding or the like. In this case, the elementary portions 802 having a trapezoidal cross-section are arranged in a line and mutually coupled by the linear strip 803. It is to be noted that each terminal 801 is embedded in each elementary portion 802. In addition, a core portion 804 having a cylindrical or polygonal outer surface is integrally connected to one end of the strip 803.

Then, a cylinder as illustrated in the figure is formed by winding the strip 803 around the core portion 804, with the core portion 804 being in the center. In this case, the strip 803 is arranged on the outside of the cylinder, the elementary portions 802 face the inside of the cylinder, and slanted side surfaces of the adjacent elementary portions 802 are brought into contact with each other. The thus formed cylinder is attached inside a metal or plastic bush 805 to obtain a cylindrical connector.

SUMMARY OF THE INVENTION

However, in the above-mentioned conventional cylindrical connector, a sealing performance is not considered. Therefore, in the case where the cylindrical connector is used in applications that require cleaning, cleaning liquid that is used for cleaning the side of the cylinder from which the tip portions of the terminals 801 project to contact counterpart connector terminals, may enter the side of cylinder at which the root portions of the terminals 801 are connected to the electrical wires or the like of the cable, and it may have adverse effects such as corrosion of connecting portions of the root portions of the terminals 801 and the electrical wires or the like, or cracking caused by deterioration.

It is therefore a general object of the present invention to solve the above-described conventional problems and provide a watertight connector and a method of manufacturing the same, by which opposite ends of respective terminals are separated in a watertight manner, so that penetration of liquid from one end side of the terminals into the other end side of the terminals is reliably prevented, the manufacture of the watertight connector is facilitated, and the manufacturing cost of the watertight connector is reduced, by molding at least one linear intermediate holding part by overmolding at least portions of respective terminals with a first resin, bending the intermediate holding part into a circular arc shape, and overmolding at least a portion of the circular-arc shaped intermediate holding part with a second resin.

For solving this object, a watertight connector, according to the present invention, includes: a plurality of terminals having contact portions for contacting counterpart terminals of a counterpart connector and connection portions to be connected to other conductive members; a housing portion made of an insulating material and molded so as to integrate the terminals between the contact portions and the connection portions; the housing portion comprising a body portion having a cylindrical-surface-like outer circumferential wall surface and a cylindrical skirt portion integrally connected to the body portion at one end of the outer circumferential wall surface; and the contact portions being exposed to the outer circumference wall surface, at least free ends of the connection portions extending from the body portion in a space formed in the skirt portion.

In the watertight connector according to another aspect of the present invention, the body portion has a through hole; and at least the free ends of the connection portions are arranged annularly around the through hole.

In the watertight connector according to a further aspect of the present invention, the housing portion is integrally connected to the body portion and has a first fitting portion extending in a direction opposite to the skirt portion, and the through hole also extends through the first fitting portion.

A method of manufacturing a watertight connector, according to the present invention, includes: steps of forming a plurality of terminals having one ends coupled to a carrier portion and arranged in a line; forming at least one intermediate holding part holding a plurality of terminals in the arranged state, by overmolding at least portions of the terminals with a first resin; bending the intermediate holding parts into a circular arc shape after removing the carrier portion; and forming a housing portion comprising a body portion having a cylindrical-surface-like outer circumferential wall surface, by overmolding at least a portion of the at least one intermediate holding part having the circular arc shape with a second resin.

In the method of manufacturing a watertight connector, according to another aspect of the present invention, the intermediate holding part comprises terminal holding portions for covering at least portions of respective terminals and thin sheet-like connecting portions for connecting adjacent terminal holding portions, and the terminal holding portions and the connecting portions are alternately arranged.

In the method of manufacturing a watertight connector according to a further aspect of the present invention, the terminals comprise contact portions for contacting counterpart terminals of a counterpart connector and connection portions to be connected to other conductive members, and the contact portions are exposed to one surface of the intermediate holding part and the connection portions extend from the intermediate holding part.

In the method of manufacturing a watertight connector, according to a still further aspect of the present invention, the intermediate holding part is bent into a circular arc shape so that the contact portions face a side opposite to a center of curvature of the circular arc.

In the method of manufacturing watertight connector, according to a still further aspect of the present invention, end portions of the or a plurality of intermediate holding parts having a circular arc shape are arranged to approach each other so as to form an annular shape and the at least a portion of the at least one intermediate holding part is overmolded with the second resin.

The method of manufacturing a watertight connector, according to a still further aspect of the present invention, it further includes step of integrally connecting a cylindrical skirt portion to the body portion.

According to the present invention, the watertight connector is manufactured by molding the linear intermediate holding part by overmolding at least portions of respective terminals with a first resin, bending the intermediate holding part into a circular arc shape, and overmolding at least a portion of the circular-arc shaped intermediate holding part with a second resin. Thereby, opposite end portions of respective terminals can be separated in a watertight manner, so that penetration of liquid from one end side of the terminals into the other end side of the terminals can be reliably prevented, and the manufacture of the watertight connector is facilitated, and the manufacturing cost can be reduced.

BRIEF DESCRIPTION OF THE DRAWINGS

FIGS. 13A to 13C are three side views of the base part formed of the joined unit base parts according to the embodiment of the present invention;

DESCRIPTION OF THE PREFERRED EMBODIMENTS

Preferred embodiment of the present invention will now be described below in detail with reference to the accompanying drawings.

Figure 1A:
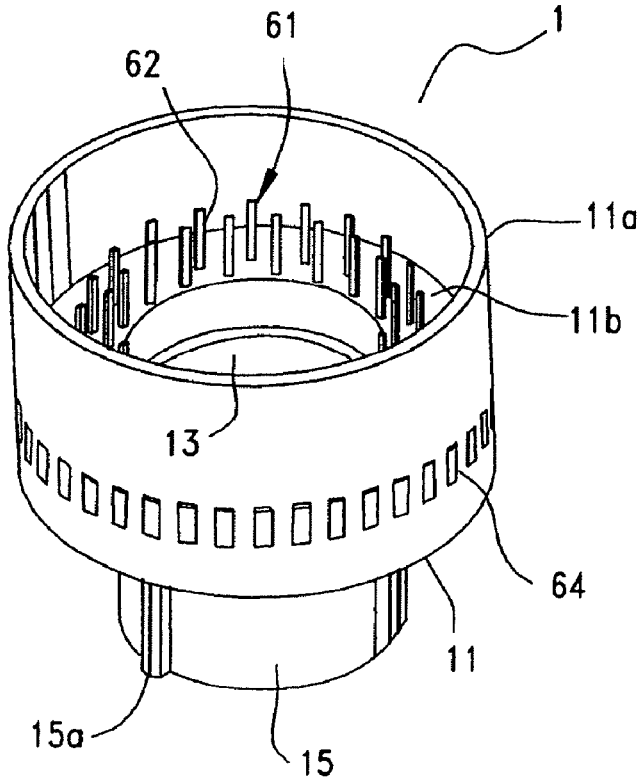
FIGS. 1A and 1B are perspective views of a watertight connector according to an embodiment of the present invention.
Figure 1B:
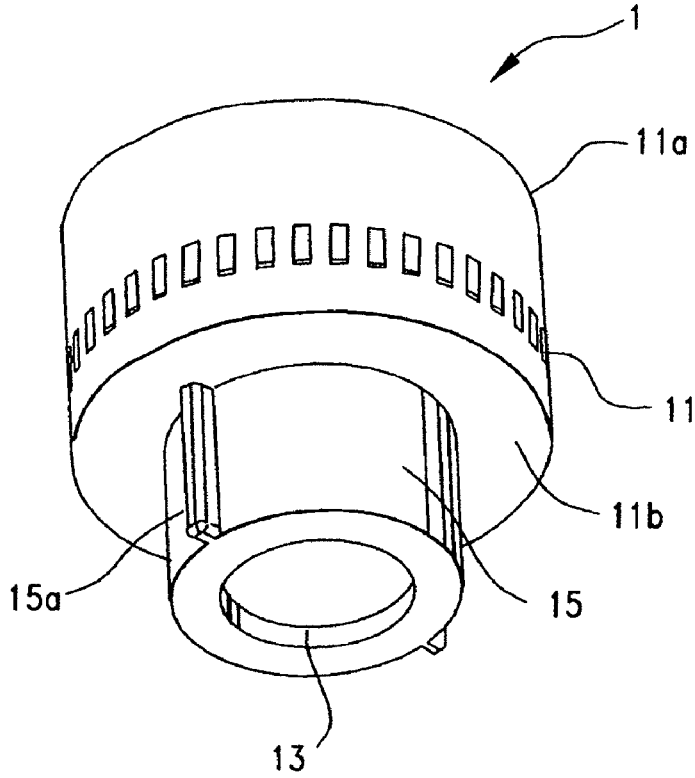
Figure 2A:
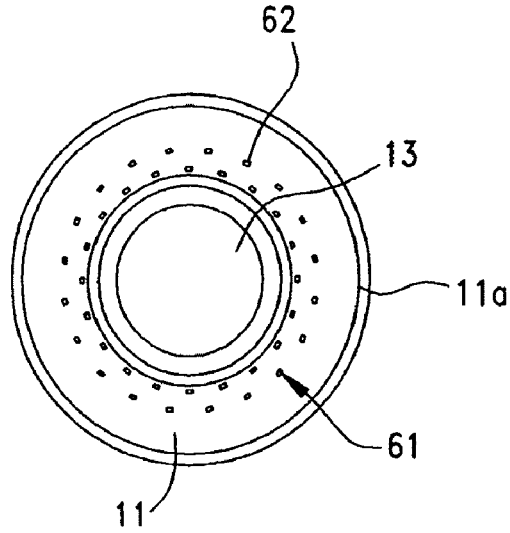
FIGS. 2A to 2C are three side views of the watertight connector according to the embodiment of the present invention.
Figure 2B:
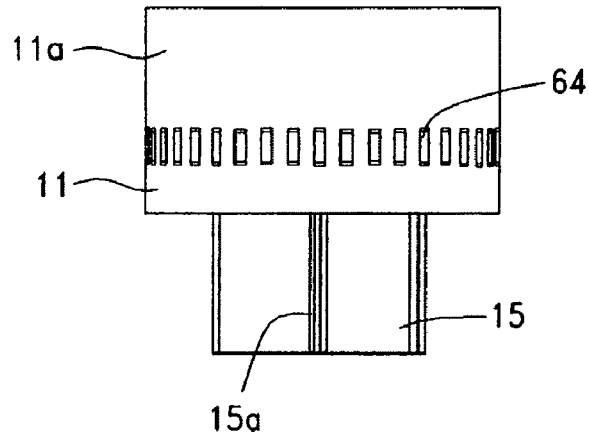
Figure 2C:
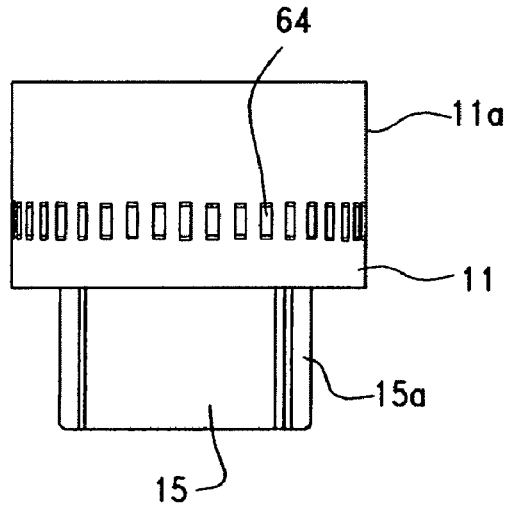

FIGS. 1A and 1B are perspective views of a watertight connector according to of the present invention. FIGS. 2A to 2C are three side views of the watertight connector according to the embodiment of the present invention, in which FIG. 2A is a front view, FIG. 2B is a plan view, and FIG. 2C is a side view.

In the drawings, reference numeral 1 designates the watertight connector, which includes a housing portion 11 made of an insulating material conductive, terminals 61 attached to the housing portion 11, a first fitting portion 15 which is integrally formed with the housing portion 11, and made of an insulating material and fitted in a counterpart connector 101, described later.

In this embodiment, representations of directions such as up, down, left, right, front, rear, and the like, used for explaining the structure and movement of each part of the watertight connector 1, are not absolute, but relative. These representations are appropriate when each part of the watertight connector 1 is in the position shown in the figures. If the position of the watertight connector changes, however, it is assumed that these representations are to be changed according to the change of the position of the watertight connector 1. In addition, two-color molding (multiple molding) referred to as double molding, outsert molding, insert molding, and the like, among the resin molding technologies, are referred to as overmolding.

In the embodiment, the watertight connector 1 is used for medical devices, for instance, but it may be used for any purposes. The watertight connector 1 is a cylindrical connector suitable for connecting conductive wires of a cable 91, which will be illustrated later, and which comprises a further linear member such as an optical fiber or the like and conductive wires integrally arranged with the further linear member, with the conductive wires annularly arranged around the centrally arranged further linear member so as to surround the latter, but it may be used for connecting conductive wires of any type of cable.

The housing portion 11 includes a thick-plate-like and ring-shaped or annular body portion 11*b* having a through hole 13 with a circular cross-section formed in the center thereof, and a cylindrical skirt portion 11*a* extending upward and integrally connected to the upper end of the outer circumferential wall surface of the body portion 11*b*. In addition, the cylindrical first fitting portion 15 extending downward is integrally connected to the lower end of the inner circumferential wall surface of the body portion 11*b*. Thereby, the housing portion 11 has, as a whole, a shape like a stepped cylinder with a large diameter portion and a small diameter portion. The housing portion 11 has the external diameter of about 30 mm, for instance, and each of the skirt portion 11*a*, the body portion 11*b*, and the first fitting portion 15 has the minimum thickness of about 0.35 mm, however, the size of each part of the watertight connector 1 may be arbitrary set.

In addition, the first fitting portion 15 is a portion to be fitted in the counterpart connector 101 and rib-like projecting portions 15*a* extending in the axial direction are integrally formed on the outer circumference wall surface of the first fitting portion 15. The projecting portion 15*a*, for instance, engages with a concave portion 116, which will be described later, of the counterpart connector 101 and is used as a rotation stopper for preventing the watertight connector 1 from rotating relative to the counterpart connector 101 and vice versa, however, the projecting portion 15*a* may be used for any purpose. Further, in the illustrated embodiment, two projection portions 15*a* are formed in two positions, however, the number of the projection portions 15*a* and positions or the like for disposing the projection portions 15*a* may be arbitrary set.

Further, the skirt portion 11*a* is used as a second fitting portion which is directly connected to a cable connector fitted in the cable 91 or conductors of the cable 91.

The through hole 13 also extends through the first fitting portion 15, and if the watertight connector 1 is used for connecting conductive wires of a medical endoscope, a catheter, or the like, for example, and the further linear member such as the optical fiber, a tubular member, or the like can pass through the through hole 13.

In this embodiment, a plurality of terminals 61 are embedded in the body portion 11*b* of the housing portion 11 in a watertight manner. A tail portion 62 as a connection portion formed at one end of each terminal 61 extends upward from the upper surface of the body portion 11*b* in a space formed in the skirt portion 11*a*, and a contact portion 64 formed in the vicinity of the other end of each terminal 61 is exposed to the outer circumference wall surface of the body portion 11*b*. Each of the tail portions 62 is connected to each of a plurality of conductive wires included in the cable 91 to be connected to the watertight connector 1. In the illustrated embodiment, the tail portions 62 are arranged on two concentric circles (two pitch circle diameters), however, the arrangement of the tail portions 62 may be arbitrary changed. For instance, the tail portions 62 may be arranged on one circle (one pitch circle diameter) or on three or more concentric circles (three or more pitch circle diameters). In addition, each of the contact portions 64 contacts and makes electrical connection to each of counterpart terminals 161 included in the counterpart connector 101 fitted with the watertight connector 1.

As described above, the tail portions 62 and the contact portions 64 are separated by the housing portion 11 in a watertight manner, since the terminals 61 are embedded in the body portion 11*b* of the housing portion 11, there is no gap between the terminals 61 and the body portion 11*b*, and the circumference of the tail portions 62 are surrounded by the skirt portion 11*a*. Thus, the penetration of any liquid such as cleaning liquid or the like from the side of the contact portions 64 into the side of the tail portions 62 is prevented by the housing portion 11, when cleaning the fitting side of the watertight connector 1, that is, the side of the contact portions 64.

Next, a method of manufacturing the watertight connector 1 having the above-described structure is explained. First, a method of overmolding portions of the terminals 61 with a first resin is explained.

Figure 3:
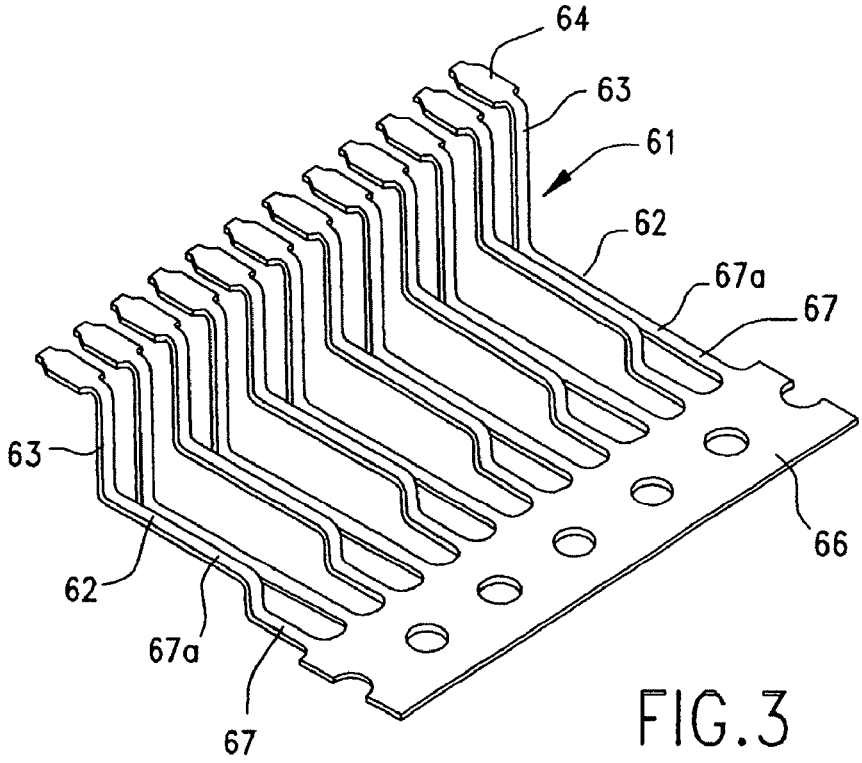
FIG. 3 is a perspective view of the terminals according to the embodiment of the present invention.
Figure 5:
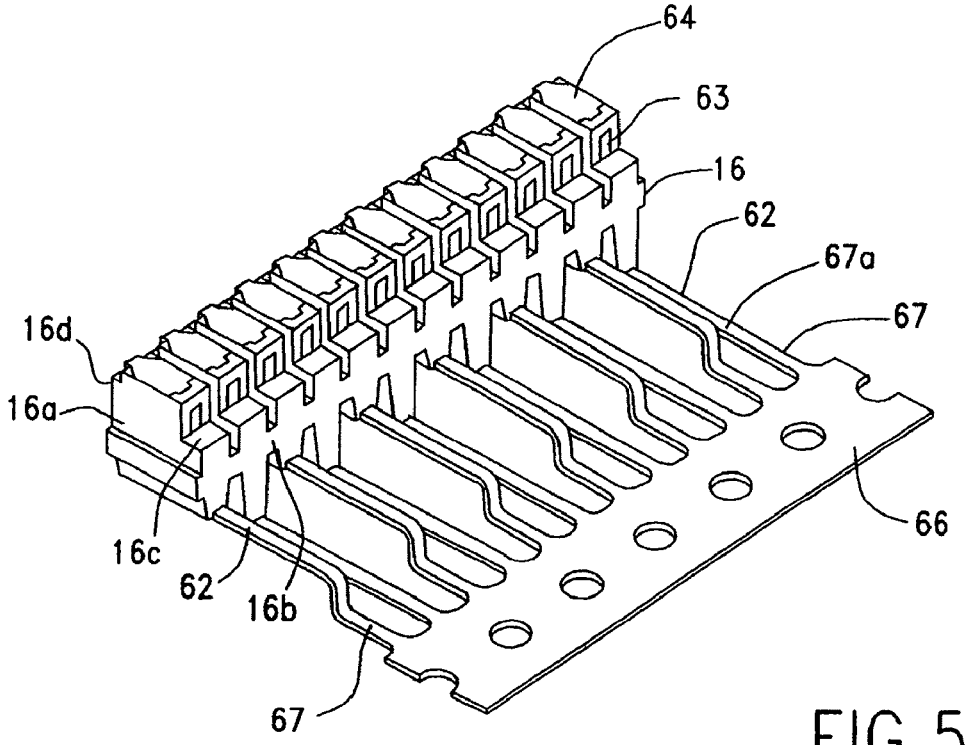
FIG. 5 is a perspective view of the terminals according to the embodiment of the present invention, in the state where portions of the terminals are overmolded with the first resin.
Figure 4C:
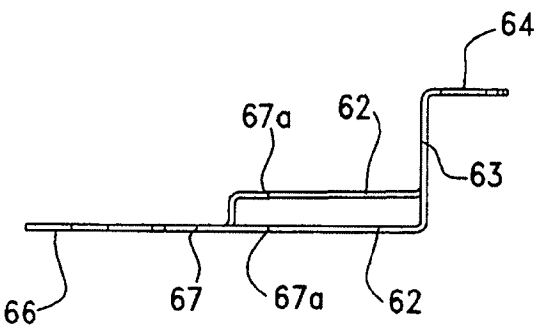
FIGS. 4A to 4C are three side views of the terminals according to the embodiment of the present invention.
Figure 4B:
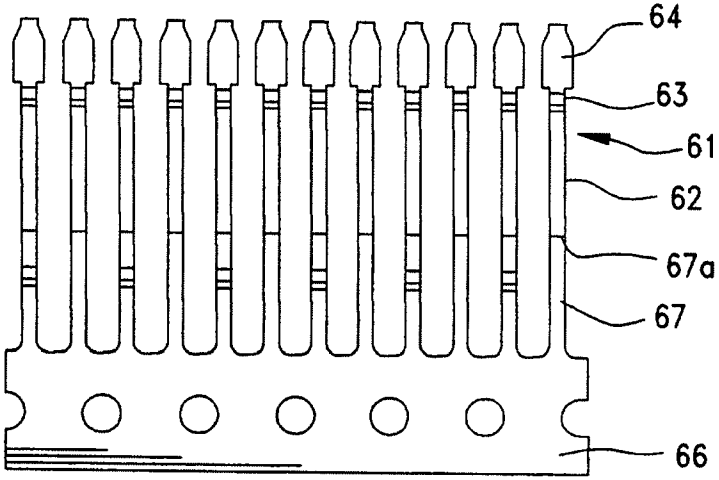
Figure 4A:
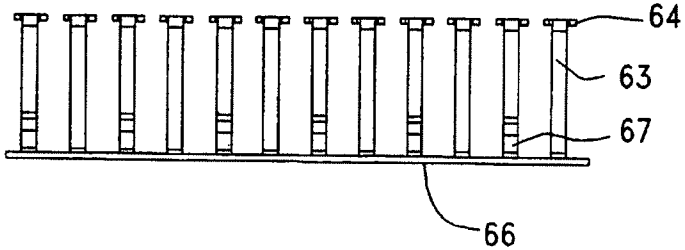
Figure 6B:
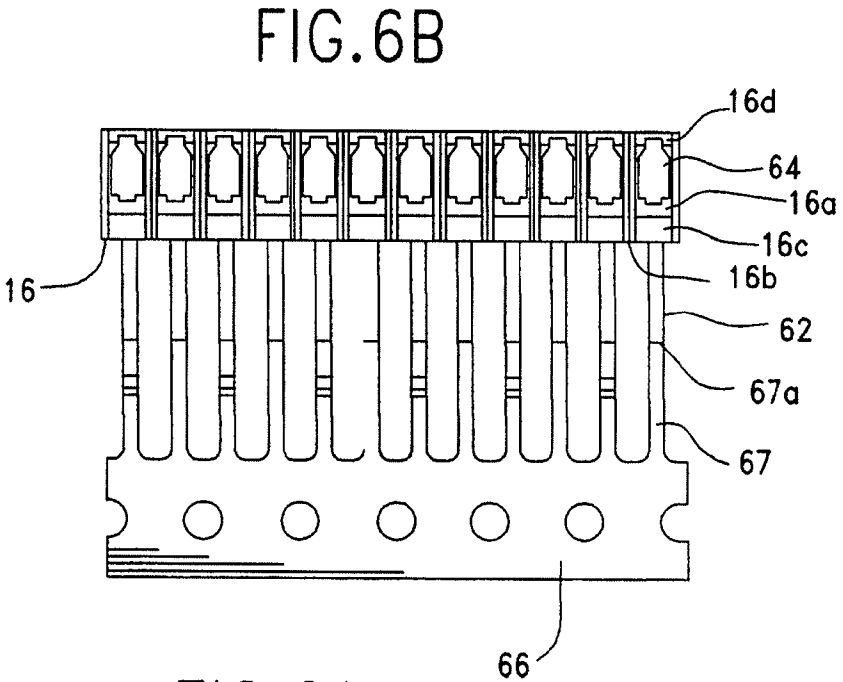
FIGS. 6A to 6C are three side views of the terminals according to the embodiment of the present invention, in the state where portions of the terminals are overmolded with the first resin.
Figure 6A:
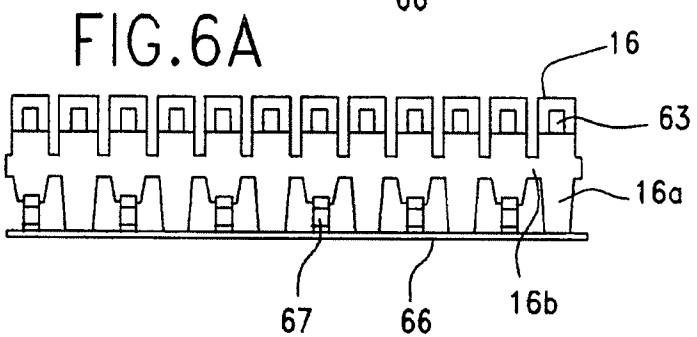
Figure 6C:
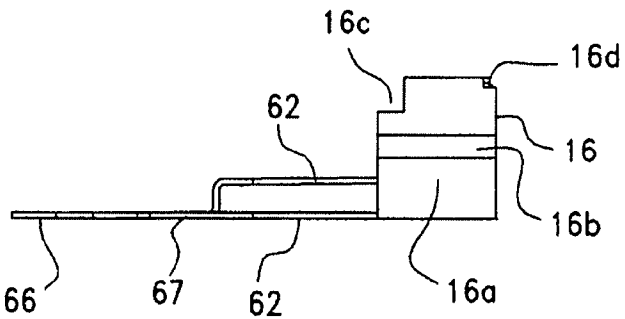
Figure 7:
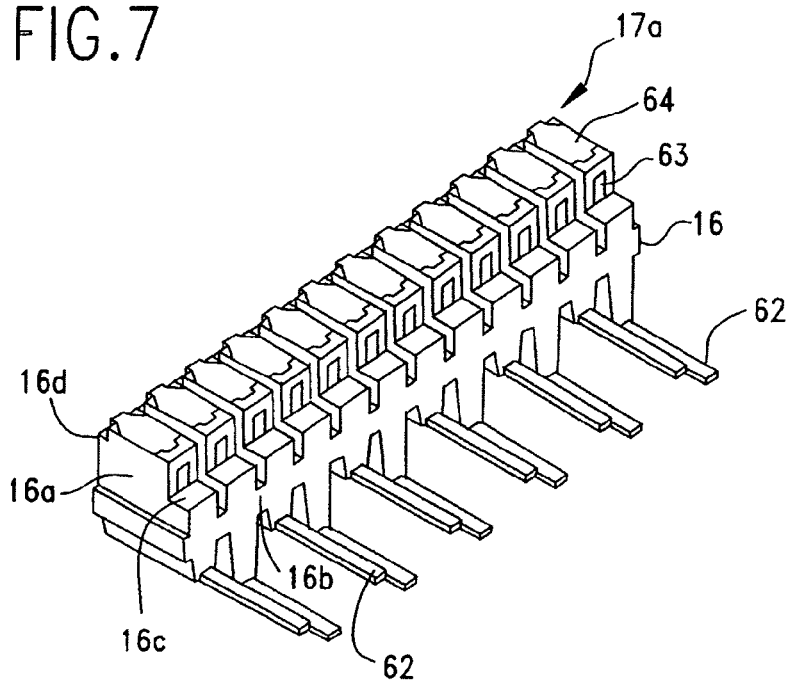
FIG. 7 is a perspective view of the terminals according to the embodiment of the present invention, in the state where the carrier portion is removed from the terminals overmolded with the first resin.
Figure 8C:
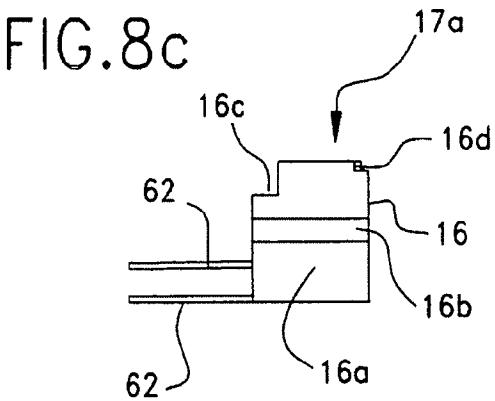
FIGS. 8A to 8C are three side views of the terminals according to the embodiment of the present invention, in the state where the carrier portion is removed from the terminals overmolded with the first resin.
Figure 8B:
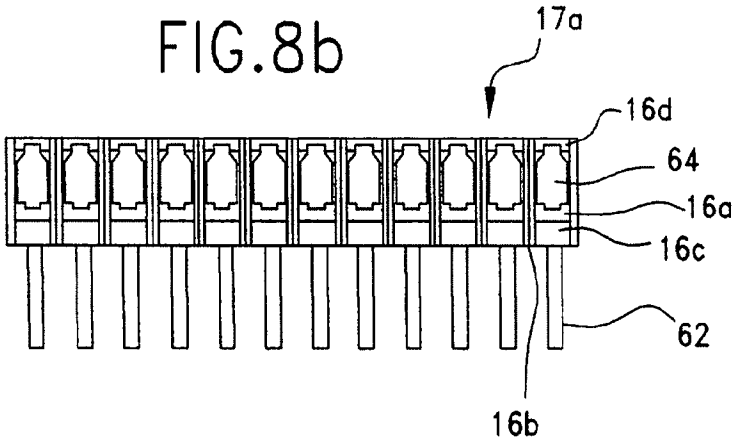
Figure 8A:
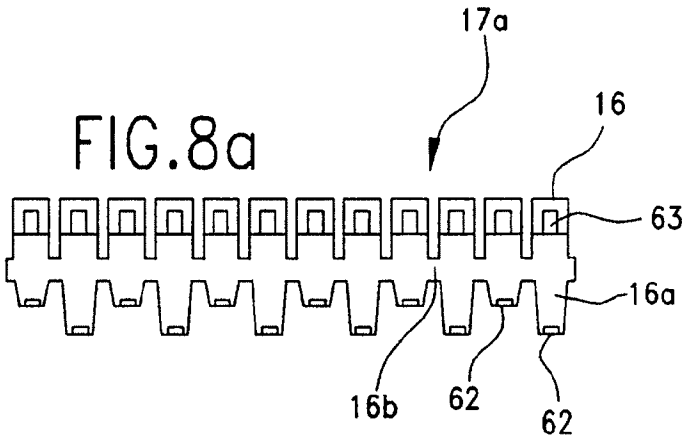

FIG. 3 is a perspective view of the terminals according to the embodiment of the present invention. FIGS. 4A to 4C are three side views of the terminals according to the embodiment of the present invention, in which FIG. 4A is a front view, FIG. 4B is a plan view, and FIG. 4C is a side view. FIG. 5 is a perspective view of the terminals according to the embodiment of the present invention, in the state where portions of the terminals are overmolded with the first resin. FIGS. 6A to 6C are three side views of the terminals according to the embodiment of the present invention, in the state where portions of the terminals are overmolded with the first resin, in which FIG. 6A is a front view, FIG. 6B is a plan view, and FIG. 6C is a side view. FIG. 7 is a perspective view of the terminals according to the embodiment of the present invention, in the state where the carrier portion is removed from the terminals overmolded with the first resin. FIGS. 8A to 8C are three side views of the terminals according to the embodiment of the present invention, in the state where the carrier portion is removed from the terminals overmolded with the first resin, in which FIG. 8A is a front view, FIG. 8B is a plan view, and FIG. 8C is a side view.

First, a conductive metal plate is subjected to punching and bending to form the terminals 61 as illustrated in FIGS. 3 to 4C. The terminals 61 are coupled to a carrier portion 66 which is used for transportation or the like and will be removed in a following step, and a plurality of terminals 61 are integrally formed with each other. As illustrated in FIGS. 3 to 4C, each terminal 61 includes an elongated belt-like linear body portion 63 which is embedded in the housing portion 11, the contact portion 64 having the shape of a baseball home plate and perpendicularly connected to the upper end of the body portion 63, and the elongated belt-like linear tail portion 62 perpendicularly connected to the lower end of the body portion 63, and the terminal 61 has, as a whole, a substantially cranked side shape. Further, the tail portion 62 of each terminal 61 is coupled to the broad belt-like linear carrier portion 66 via an elongated belt-like connecting portion 67. Reference numeral 67*a* designates a boundary line indicating a boundary between the tail portion 62 and the connecting portion 67, and the cutting will be performed along the boundary line 67*a* when the carrier portion 66 will be removed in the following step.

In the embodiment shown in FIGS. 3 to 4C, the terminals 61 with longer body portions 63 and the terminals 61 with shorter body portions 63 are alternatively arranged so that the tail portions 62 can be arranged on two concentric circles as described above, in which the tail portions 62 of the terminals 61 with the longer body portions 63 form the inner circle in FIG. 2B and the tail portions 62 of the terminals 61 with the shorter body portions 63 form the outer circle in FIG. 2B. For instance, when the tail portions 62 cooperate to form a single circle, all of the body portions 63 are formed to be equal in length, and when the tail portions 62 form three concentric circles, the body portions 61 are formed to have three different levels of length.

Subsequently, portions of the terminals 61 are overmolded with the first resin by a molding method such as injection molding, cast molding, or the like, so as to form a harmonica part 16 as an intermediate holding part, as illustrated in FIGS. 5 to 6C. In this case, at least portions of the contact portions 64, the body portions 63, and the tail portions 62 are set in a primary metal mold (not shown) and the melted first resin is filled in the primary metal mold so as to form the harmonica part 16 integrated with portions of the terminals 61. For instance, the first resin may be a PPS (Poly Phenylene Sulfide) resin, but any type of resin may be used as long as the resin can be used in the molding methods such as injection molding, cast molding, or the like, and has appropriate flexibility.

The harmonica part 16 includes core portions 16*a* as terminal holding portions for covering at least portions of the contact portions 64, the body portions 63, and the tail portions 62, and thin sheet-like connecting portions 16*b* for connecting adjacent core portions 16*a*. With this structure, the harmonica portion 16 as a whole is a linear member as illustrated in FIG. 6A, and has a concertina shape or a shape suggestive of successive openings of a harmonica as seen from the front. In addition, a first cut-away portion 16*c* and a second cut-away portion 16*d* are formed in the core portion 16*a*, having such a shape that corners of the upper surface are cut-away at substantially right angle.

The plate-like contact portion 64 is almost entirely embedded in the core portion 16*a*, except for the upper surface of the contact portion 64 exposed to the upper surface of the core portion 16*a*. In addition, the body portion 63 is almost entirely embedded in the core portion 16*a*, except for a portion of the surface of the body portion 63 exposed to one surface of the first cut-away portion 16*c*. Further, a portion of the tail portion 62 near the body portion 63 is embedded in the core portion 16*a*, but a portion of the tail portion 62 near the connecting portion 67 extends outwards from the core portion 16*a*.

Subsequently, the connecting portion 67 is cut off from the tail portion 62 along the boundary line 67*a* to remove the carrier portion 66 and the connecting portions 67. Thereby, a unit base part 17*a* as illustrated in FIGS. 7 to 8C can be obtained. The unit base part 17*a* comprises the harmonica part 16 and the terminals 61 having portions embedded in the core portions 16*a* of the harmonica part 16.

Next, a method of manufacturing the watertight connector 1, by overmolding at least a portion of the harmonica part 16 with the second resin.

Figure 9:
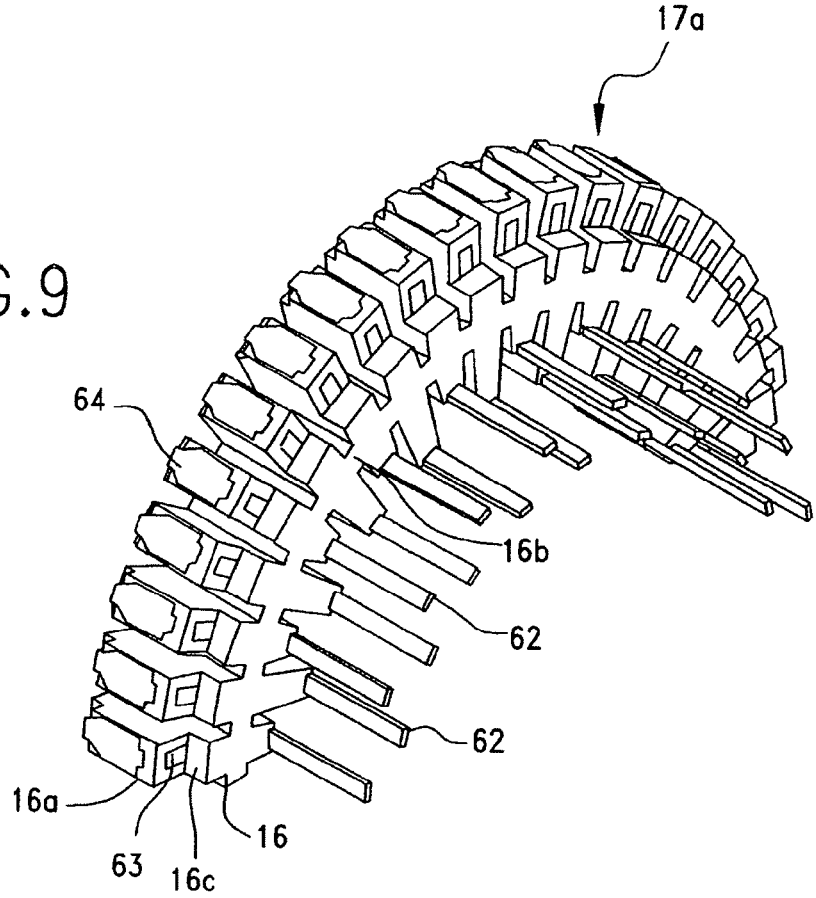
FIG. 9 is a first perspective view of the unit base part according to the embodiment of the present invention, in the state where the unit base part is deformed into a circular arc shape.
Figure 10:
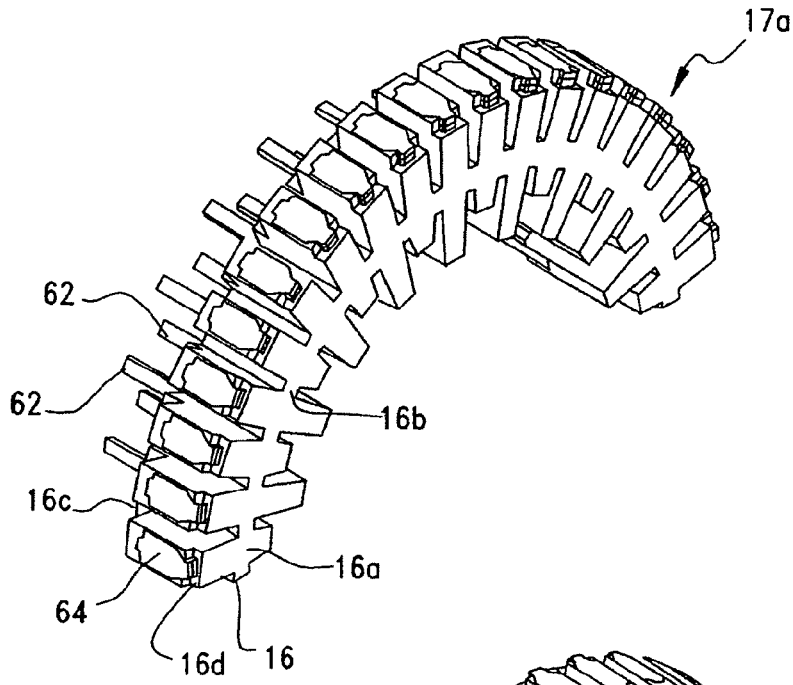
FIG. 10 is a second perspective view of the unit base part according to the embodiment of the present invention, in the state where the unit base part is deformed into the circular arc shape.
Figure 12:
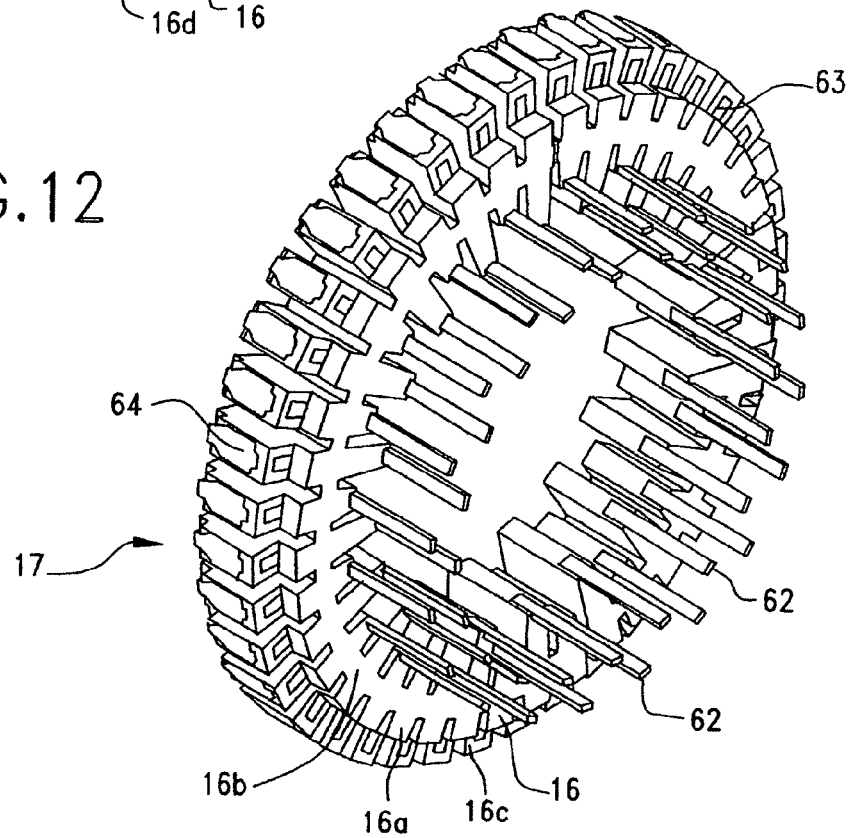
FIG. 12 is a perspective view of the base part formed of joined unit base parts according to the embodiment of the present invention.
Figure 11A:
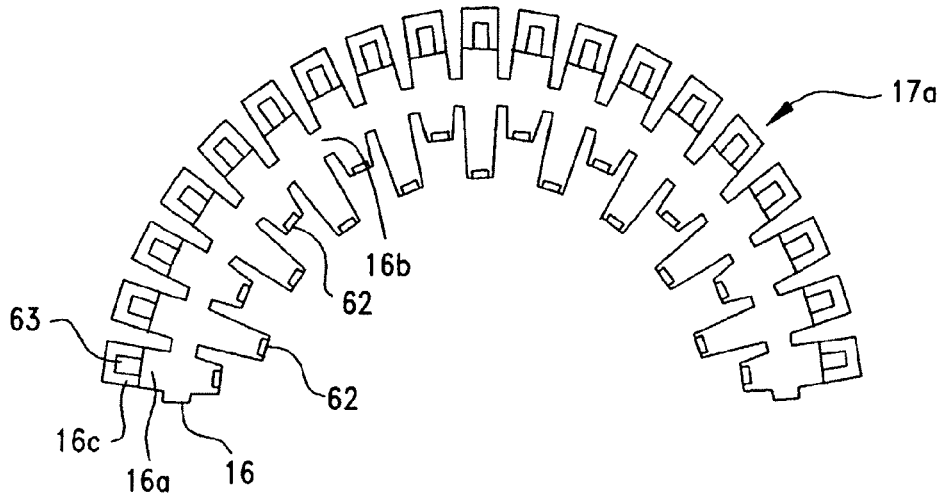
FIGS. 11A and 11B are two side views of the unit base part according to the embodiment of the present invention, in the state where the unit base part is deformed into the circular arc shape.
Figure 11B:
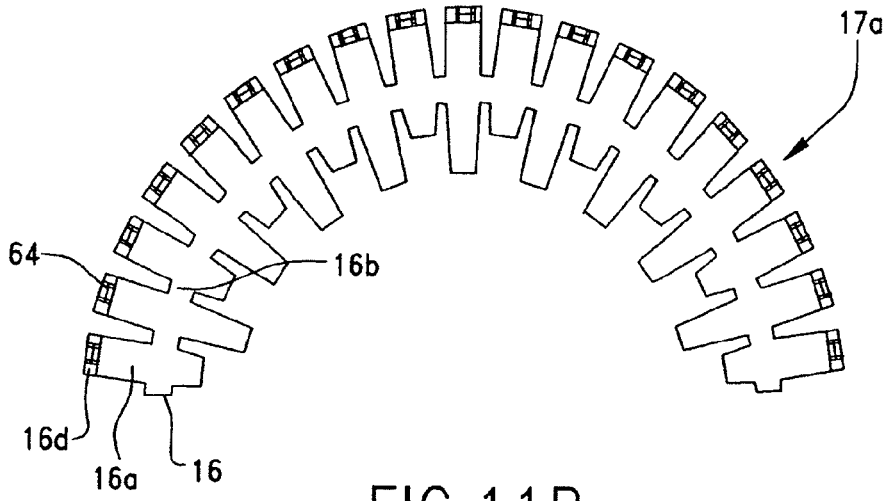

FIG. 9 is a first perspective view of the unit base part according to the embodiment of the present invention, in the state where the unit base part is deformed into a circular arc shape. FIG. 10 is a second perspective view of the unit base part according to the embodiment of the present invention, in the state where the unit base part is deformed into the circular arc shape. FIGS. 11A and 11B are two side views of the unit base part according to the embodiment of the present invention, in the state where the unit base part is deformed into the circular arc shape, in which FIG. 11A is a front view and FIG. 11B is a rear view. FIG. 12 is a perspective view of the base part formed of joined unit base parts according to the embodiment of the present invention. FIGS. 13A to 13C are three side views of the base part formed of the joined unit base parts according to the embodiment of the present invention, in which FIG. 13A is a front view, FIG. 13B is a plan view, and FIG. 13C is a side view.

First, the harmonica portion 16 is deformed by bending it into the circular arc shape, as illustrated in FIGS. 9 to 11B. In this case, when seen from the front, as illustrated in FIG. 11A, the harmonica portion 16 is deformed so that the line connecting the connecting portions 16*b* forms a circular arc, the top surface of the core portion 16*a*, that is, the surface to which the contact portion 64 is exposed, faces outward, and the lower surface of the core portion 16*a* faces inward. In other words, the arrangement is such that the contact portions 64 face the side opposite to the center of curvature of the arc. The harmonica part 16 includes core portions 16*a* and the thin plate-like connecting portions 16*b* for connecting adjacent core portions 16*a*, and the core portions 16*a* and the connecting portions 16*b* are alternately arranged, so it is possible to form the line connecting the connection portions 16*b* into a circular arc shape, by bending the connection portions 16*b*. It is to be noted that the curvature of the circular arc formed by the line connecting the connection portions 16*b* can be appropriately set.

Subsequently, a ring-shaped or annular base part 17 as illustrated in FIGS. 12 to 13C can be obtained by using a plurality of unit base parts 17*a* having the circular arc shape. In this case, end portions of the harmonica parts 16 are joined or approached each other. The base part 17 is a ring-shaped or annular member having an outer circumferential surface on which a plurality of contact portions 64 are arranged in a line, and includes a plurality of tail portions 62 extending from one of the surfaces perpendicular to the axial direction of the ring or loop and in the axial direction. Here, in the illustrated embodiment, the tail portions 62 are so arranged to form two concentric circles.

In this case, the number of the unit base parts 17*a* required for forming one base part 17 varies according to the length of the unit base parts 17*a* and the curvature of the circular arc formed by the line connecting the connecting portions 16*b*. For instance, if the length of the unit base parts 17*a* is shorter, the number of the unit base parts 17*a* required for forming one base part 17 increases even when the curvature is constant. In addition, even if the length of the unit base parts 17*a* is constant, for instance, the number of the unit base parts 17*a* required for forming one base part 17 decreases when the curvature is small. It is to be noted that when the length of the unit base parts 17*a* is sufficiently long, as illustrated in FIGS. 12 to 13C, the base part 17 can be obtained by joining opposite ends of one unit base part 17*a* or bringing them in close proximity to each other.

Subsequently, at least the housing portion 11 of the watertight connector 1, as illustrated in FIGS. 1 and 2, is formed, by overmolding at least portions of the harmonica parts 16 included in the base part 17 with the second resin by molding the method such as injection molding, cast molding, or the like. In this case, the base part 17 is set in a secondary mold (not shown) and the melted second resin is filled therein to form the body portion 11*b* of the housing portion 11 which is integrated with at least portions of the harmonica parts 16.

Incidentally, when the watertight connector 1 is used for medical devices, for instance, it is preferable that the second resin be a resin which is highly resistant to chemicals and is verified that the resin has no adverse effect on the human body, such as Radel® polyphenylsulfon, or the like, however, the second resin may be other resins. By this, the second resin is filled in a space formed between the adjacent core portions 16*a* of the harmonica parts 16, and in the first cut-away portion 16*c* and the second cut-away portion 16*d*, and the like, to obtain the thick-plate, ring-shaped or annular body portion 11*b*.

In addition, since the annular base part 17 is set in the secondary mold, the terminals 61 may be accurately set in the secondary mold in the annularly arranged state.

Generally, it is easy to accurately set the terminals 61 linearly arranged in the mold, however, it is difficult to accurately set the annularly arranged terminals 61 in the mold. That is, as illustrated in FIGS. 3 to 4C, the terminals 61 are formed by subjecting a metal plate to punching and bending, and are coupled to the linear carrier portion 66, so a plurality of terminals 61 are integrally formed. For this reason, with the use of the carrier portion 66, it is relatively easy to accurately place the terminals 61 in a linear cavity of a primary mold with the terminals 61 maintained in the linearly arranged state so that predetermined distances from respective portions of the terminals 61 to respective portions of the cavity surface are ensured. On the contrary, it is extremely difficult to place the terminals 61 in a circular cavity of a secondary mold with the terminals 61 maintained in the annularly arranged state so that predetermined distances from respective portions of the terminals 61 to respective portions of the cavity surface are ensured.

However, in this embodiment, since the base part 17 obtained by overmolding portions of the terminals 61 with the first resin is set in the secondary mold, it is possible to ensure predetermined distances from respective portions of the terminals 61 to respective portions of the cavity surface, by bringing portions of the resin overmolding the terminals 61, that is, for instance, surfaces of respective portions of the core portions 16*a*, into contact with respective portions of the cavity surface. Therefore, it becomes easy to accurately set the terminals 61 in the circular cavity of the secondary mold so that predetermined distances from respective portions of the terminals 61 to respective portions of the cavity surface are ensured even when the terminals 61 are annularly arranged.

Subsequently, the first fitting portion 15 and the skirt portion 11*a* are integrally connected to the body portion 11*b*, by a molding method such as double molding, or the like. It is to be noted that the first fitting portion 15 and the skirt portion 11*a* can be sequentially connected to the body portion 11*b* in a separate molding step or can be connected to the body portion 11*b* at the same time in the same molding step. Further, the first fitting portion 15 and/or the skirt portion 11*a* can be molded integrally with the body portion 11*b* when forming the body portion 11*b* by overmolding the base portion 17 with the second resin. Thereby, the watertight connector 1 as illustrated in FIGS. 1 to 2C can be obtained.

Next, an example of use of the watertight connector 1 is explained.

Figure 14A:
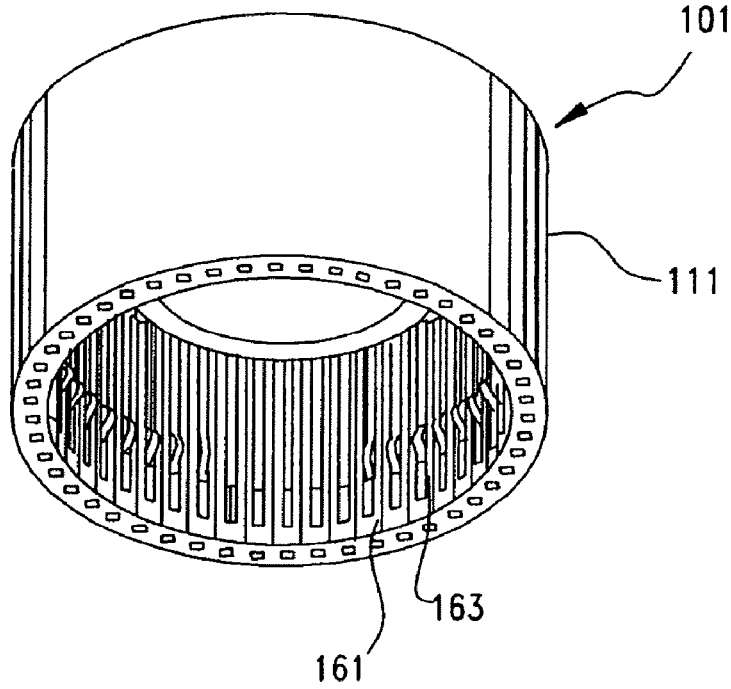
FIGS. 14A and 14B are perspective views of the counterpart connector according to the embodiment of the present invention.
Figure 14B:
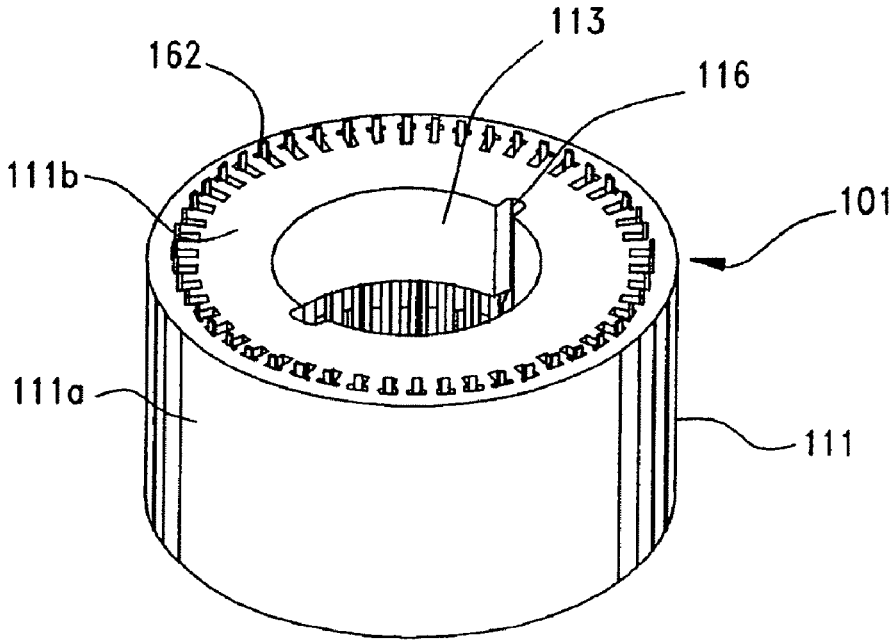
Figure 15A:
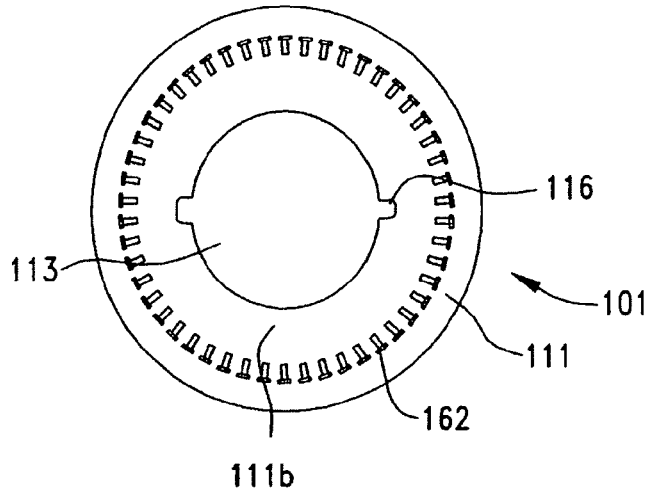
FIGS. 15A to 15C are three side views of the counterpart connector according to the embodiment of the present invention.
Figure 15B:
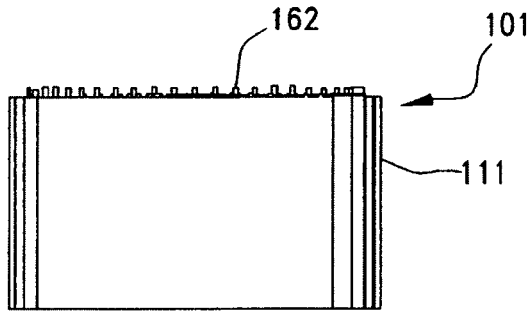
Figure 15C:
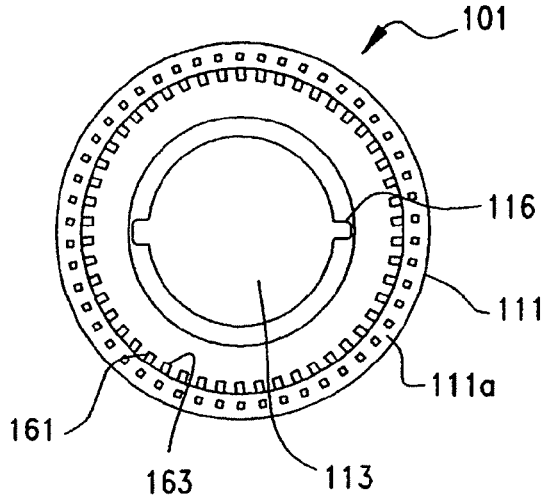
Figure 16:
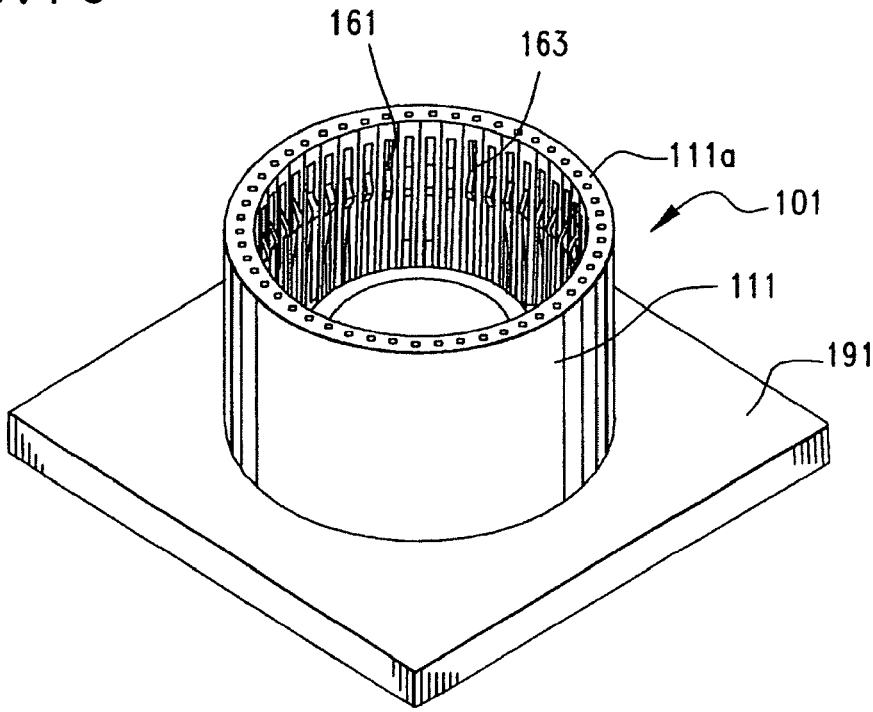
FIG. 16 is a perspective view of the counterpart connector mounted on a substrate according to the embodiment of the present invention.
Figure 19:
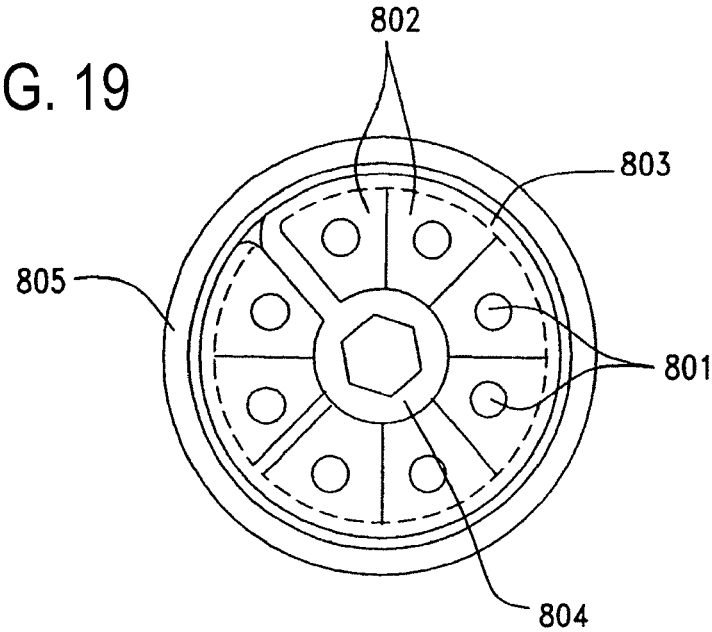
FIG. 19 is a cross-sectional view of the conventional cylindrical connector.
Figure 17:
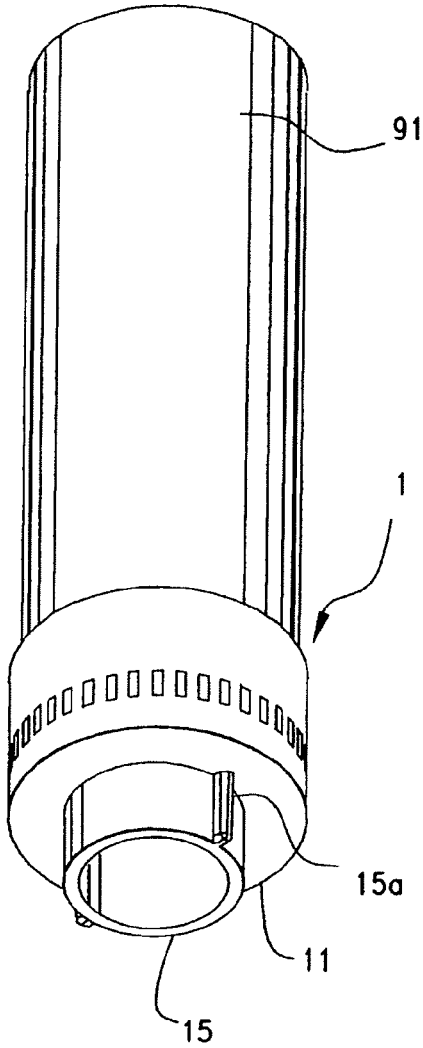
FIG. 17 is a perspective view of the watertight connector connected to a cable according to the embodiment of the present invention.
Figure 18:
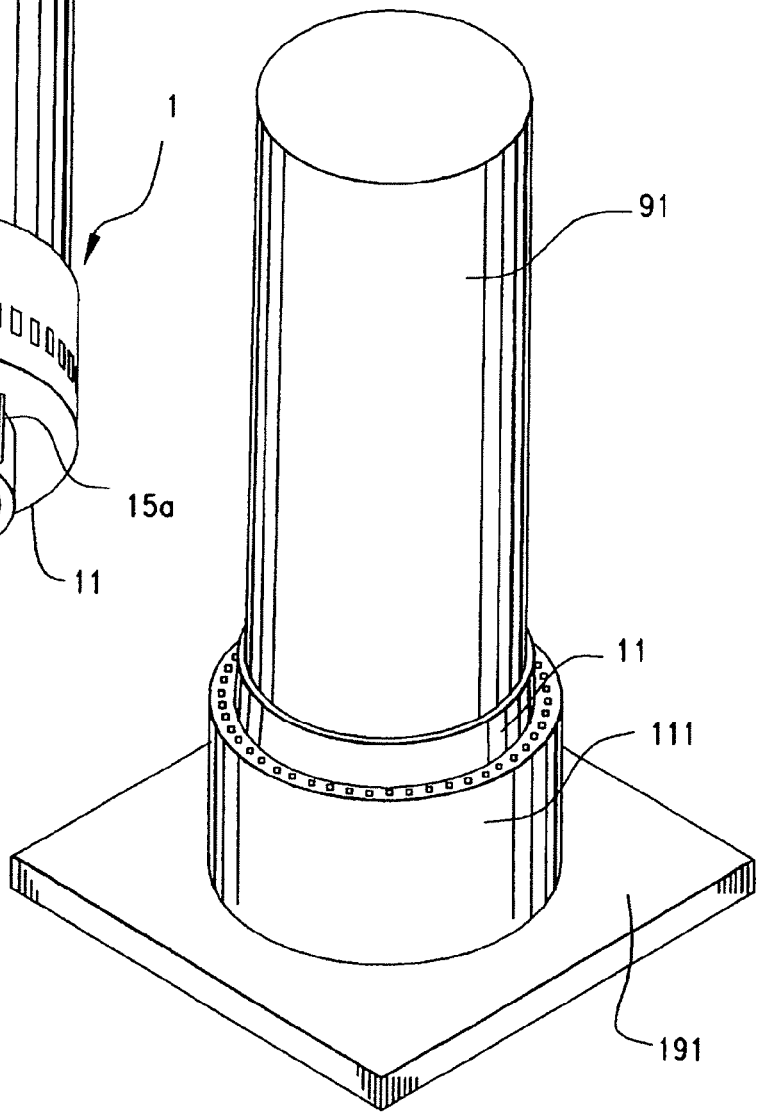
FIG. 18 is a perspective view of the watertight connector fitted in the counterpart connector according to the embodiment of the present invention.

FIGS. 14A and 14B are perspective views of the counterpart connector according to the embodiment of the present invention. FIGS. 15A to 15C are three side views of the counterpart connector according to the embodiment of the present invention, in which FIG. 15A is a bottom view, FIG. 15B is a side view, and FIG. 15C is a plan view. FIG. 16 is a perspective view of the counterpart connector mounted on a substrate according to the embodiment of the present invention. FIG. 17 is a perspective view of the watertight connector connected to a cable according to the embodiment of the present invention. FIG. 18 is a perspective view of the watertight connector fitted in the counterpart connector according to the embodiment of the present invention.

As illustrated in FIGS. 14A to 16, the counterpart connector 101 has an approximately cylindrical shape, and has a counterpart housing portion 111 made of an insulating material such as a synthetic resin and the counterpart terminals 161 made of a conductive material such as metal and provided in the counterpart housing portion 111. The counterpart housing portion 111 includes a ring-shaped or annular body portion 111*b* made of a thick plate having a through hole 113 having a circular cross-section formed in the center thereof, and a cylindrical skit portion 111*a* extending upward is integrally coupled to the upper end of the outer circumferential wall surface of the body portion 111*b*.

When the watertight connector 1 is fitted in the counterpart connector 101, it is inserted in the skirt portion 111*a*. In addition, the first fitting portion 15 of the watertight connector 1 is inserted in the through hole 113, and the relative rotation between the watertight connector 1 and the counterpart connector 101 is prevented, by the engagement of the projection portions 15*a* of the first fitting portion 15 with the concave portions 116 formed in the through hole 113.

Further, the counterpart terminals 161 are arranged in the inner surface of the skirt portion 111*a* and counterpart contact portions 163 of the counterpart terminals 161 project inward. Further, the counterpart terminals 161 and the terminals 61 are electrically connected to each other, by the contact of the counterpart contact portions 163 with the contact portions 64 of the watertight connector 1.

In addition, tail portions 162 of the counterpart terminals 161 project from the body portion 111*b*. The tail portions 162 are connected to connection pads, through holes, or the like arranged in the surface of a substrate 191 such as a printed circuit board or the like by a connection means such as soldering. Thereby, the counterpart connector 101 is mounted on the substrate 191. It is to be noted that the counterpart connector 101 may be mounted on an electric equipment such as a medical device or the like, an electronics device, or the like, instead of the substrate 191.

On the other hand, as illustrated in FIG. 17, the watertight connector 1 is coupled to the end of the cable 91. The cable 91 comprises a further linear member such as an optical fiber or the like and conductive wires as other conductive members integrated with the further linear member, with the conductive wires annularly arranged around the centrally arranged further linear member so as to surround the circumference thereof, but any type of cable may be used as the cable 91. Further, the conductive wires are connected to the tail portions 62 of the terminals 61.

With this structure, as illustrated in FIG. 18, the conductive wires of the cable 91 are connected to wirings (not shown) of the substrate 191 via the terminals 61 and the counterpart terminals 161 when the watertight connector 1 is fitted in the counterpart connector 101 mounted on the substrate 191.

As described above, in this embodiment, the harmonica part 16 is molded by overmolding at least a portion of each terminal 61 with the first resin, the unit base part 17*a* comprising the harmonica part 16 and the terminals 61 is bent into a circular arc shape to form the annular base part 17, the base part 17 is set in the mold, and at least a portion of the base part 17 is overmolded with the second resin, so that at least the body portion 11*b* of the housing portion 11 of the watertight connector 1 is molded.

Thereby, a gap between the contact portion 64 and the tail portion 62 of each terminal 61 can be separated in a watertight manner, and the penetration of liquid from the side of the contact portion 64 to the side of the tail portion 62 can be surely prevented, and thus it is possible to obtain the watertight connector 1 the manufacture of which is facilitated and the manufacturing cost of which is reduced.

Further, since the terminals 61 are set in the primary mold in the linearly arranged state when the unit base part 17*a* is formed, it is possible to easily and accurately position the terminals 61 and to overmold the terminals 61 with the first resin, and since the annular base part 17 obtained by deforming the unit base part 17*a* into a circular arc shape is set in the secondary mold when the body portion 11*b* is formed, it is possible to easily and accurately position the terminals 61 and to overmold the terminals 61 in the annularly arranged state with the second resin.

In addition, since the body portion 11*b* is molded by further overmolding at least a portion of the harmonica part 16, which is formed by overmolding at least portions of the terminals 61 with the first resin, with the second resin, the contact portions 64 and the tail portions 62 of the terminals 61 can be surely separated in a watertight manner by the body portion 11*b*. That is, if there is a gap between the harmonica part 16 formed by molding with the first resin and the terminals 61, since the further overmolding is performed with the second resin, the gap will be filled with the second resin and the gap is surely closed off. In addition, even when cracks occur in the connection portions 16*b* or the like, or when gaps occur between the terminals 61 and the core portions 16*a*, the second resin, similarly, will be further applied for overmolding, and the cracks or gaps will be surely closed off by filling the second resin.

Further, when a relatively expensive resin such as Radel® polyphenylsulfon or the like is used, the usage thereof can be suppressed by using the relatively expensive resin for only as the second resin, thereby the cost of the resin can be suppressed.

Further, in this embodiment, the explanation is made as to the case of molding the body portion 11*b* of the housing portion 11 by double molding, however, the body portion 11*b* can be molded by overmolding three or more times.

The present invention is not limited to the above-described embodiment, and may be changed in various ways based on the gist of the present invention, and these changes are not eliminated from the scope of the present invention.

What is claimed is:

1. A watertight connector comprising:

(a) a plurality of terminals including contact portions for contacting counterpart terminals of a counterpart connector and connection portions to be connected to other conductive members; and (b) a housing portion made of an insulating material and molded so as to integrate the terminals between the contact portions and the connection portions; wherein (c) the housing portion includes a body portion having a cylindrical-surface-like outer circumferential wall surface and a cylindrical skirt portion integrally connected to the body portion at one end of the outer circumferential wall surface, the plurality of terminals formed on the cylindrical-surface-like outer circumferential wall surface of the body portion;

(d) the contact portions are exposed to the outer circumferential wall surface, at least free ends of the connection portions extending from the body portion in a space formed in the skirt portion; and (e) the body portion has a through hole.

2. The watertight connector according to claim 1, wherein at least the free ends of the connection portions (62) are arranged annularly around the through hole.

3. The watertight connector according to claim 2, wherein (a) the housing portion is integrally connected to the body portion and has a first fitting portion extending in a direction opposite to the skirt portion, the skirt portion having a larger diameter than the first fitting portion; and (b) the through hole also extends through the first fitting portion.

4. A method of manufacturing a watertight connector, comprising the steps of:

(a) forming a plurality of terminals having one ends coupled to a carrier portion and arranged in a line;

(b) forming at least one intermediate holding part (16) holding a plurality of terminals in the arranged state, but overmolding at least portions of the terminals with a first resin;

(c) bending the intermediate holding part into a circular arc shape after removing the carrier portion; and (d) forming a housing portion including a body portion having a cylindrical-surface-like outer circumferential wall surface, by overmolding at least a portion of the at least one intermediate holding part having the circular arc shape with a second resin.

5. The method of manufacturing a watertight connector according to claim 4, wherein end portions of the or a plurality of intermediate holding parts having the circular arc shape are arranged to approach each other so as to form an annular shape and the at least a portion of the at least one intermediate holding part is overmolded with the second resin.

6. The method of manufacturing a watertight connector according to claim 4, further comprising step of integrally connecting a cylindrical skirt portion to the body portion.

7. The method of manufacturing a watertight connector according to claim 4, wherein the intermediate holding part comprises terminal holding portions for covering at least portions of respective terminals and thin sheet-like connecting portions for connecting adjacent terminal holding portions, and the terminal holding portions and the connecting portions are alternatively arranged.

8. The method of manufacturing a watertight connector according to claim 7, wherein (a) the terminals comprise contact portions for contacting counterpart terminals of a counterpart connector and connection portions to be connected to the other conductive members; and (b) the contact portions are exposed to one surface of the intermediate holding part and the connection portions extend from the intermediate holding part.

9. The method of manufacturing a watertight connector according to claim 8, wherein the intermediate holding part is bent into a circular arc shape so that the contact portions face a side opposite to a center of curvature of the circular arc.

* * * * *